US008986132B2

(12) United States Patent
Chen

(10) Patent No.: US 8,986,132 B2
(45) Date of Patent: Mar. 24, 2015

(54) GOLF CLUB HEAD HAVING AIR FLOW GUIDING SLOT WITH UNEVEN SURFACE

(71) Applicant: Wen-Ta Chen, Ping-Tung (TW)

(72) Inventor: Wen-Ta Chen, Ping-Tung (TW)

( * ) Notice: Subject to any disclaimer, the term of this patent is extended or adjusted under 35 U.S.C. 154(b) by 0 days.

(21) Appl. No.: 13/895,674

(22) Filed: May 16, 2013

(65) Prior Publication Data

US 2013/0316846 A1 Nov. 28, 2013

(30) Foreign Application Priority Data

May 28, 2012 (CN) ..... 2012 2 0242059 U

(51) Int. Cl.
*A63B 53/04* (2006.01)
*A63B 49/06* (2006.01)
*A63B 59/00* (2006.01)

(52) U.S. Cl.
CPC ..... *A63B 53/0466* (2013.01); *A63B 49/06* (2013.01); *A63B 2059/0011* (2013.01); *A63B 2225/01* (2013.01); *A63B 2053/0433* (2013.01); *A63B 2053/0437* (2013.01)
USPC ..... 473/327; 473/328; 473/349

(58) Field of Classification Search
CPC ..... A63B 53/0466; A63B 2225/01; A63B 49/06; A63B 2059/0011; A63B 2053/0437; A63B 2053/0433
USPC ..... 473/345, 346, 327, 328, 349
See application file for complete search history.

(56) References Cited

U.S. PATENT DOCUMENTS

| | | | | | |
|---|---|---|---|---|---|
| 3,997,170 | A | * | 12/1976 | Goldberg | 473/327 |
| 4,065,133 | A | * | 12/1977 | Gordos | 473/327 |
| 5,092,599 | A | * | 3/1992 | Okumoto et al. | 473/327 |
| D326,885 | S | * | 6/1992 | Paul | D21/733 |
| 5,700,208 | A | * | 12/1997 | Nelms | 473/324 |
| 6,001,029 | A | * | 12/1999 | Kobayashi | 473/327 |
| 6,458,042 | B1 | | 10/2002 | Chen | |
| 6,776,725 | B1 | * | 8/2004 | Miura et al. | 473/327 |

* cited by examiner

*Primary Examiner* — Sebastiano Passaniti
(74) *Attorney, Agent, or Firm* — WPAT, P.C.; Anthony King; Kay Yang

(57) ABSTRACT

The present invention provides a golf club head having air flow guiding slot with uneven surface, which includes a ball striking plate, a connection portion, a top plate, a bottom portion and at least one air flow guiding slot. The at least one air flow guiding slot is mounted on the top plate and the bottom portion, is near to the connection portion, and has an uneven surface. Utilizing the uneven surface of the at least one air flow guiding slot, the stability of air flow can be improved and the surface area of the air flow guiding slot can be greatly increased so as to raise the weight of the air flow guiding slot so that the center of gravity for the golf club head can be mounted on the at least one air flow guiding slot.

7 Claims, 7 Drawing Sheets

GOLF CLUB HEAD HAVING AIR FLOW GUIDING SLOT WITH UNEVEN SURFACE

BACKGROUND OF THE INVENTION

1. Field of the Invention

The present invention relates to a golf club head, and more particularly to a golf club head having air flow guiding slot with uneven surface.

2. Description of the Related Art

Referring to FIG. 1, it shows the conventional golf club head. Please refer to U.S. Pat. No. 6,458,042 B1. The conventional golf club head 10 includes a ball-hitting face plate 11, a threaded connection portion 12, a top curved surface 13, an arcuate side 14 and an air flow guiding slot structure 15. The top curved surface 13 is joined with the ball-hitting face plate 11 and the arcuate side 14. The juncture of the top curved surface 13, the ball-hitting face plate 11, and the arcuate side 14 is provided with the threaded connection portion 12 extending upwards therefrom. The threaded connection portion 12 is engaged with one end of a shaft of a golf club. The air flow guiding slot structure 15 is located in the top curved surface 13 and the arcuate side 14.

When the conventional golf club head 10 is swung, the air current flows through the top curved surface 13 and the arcuate side 14. As a result, an air pressure (P1) is brought about on the top curved surface 13, whereas an air pressure (P2) is brought about on the arcuate side 14. These two air flows enter the air flow guiding slot structure 15, thereby resulting in equilibrium of the pressures P1 and P2. As a result, the conventional golf club head 10 is not prone to float in the air at the time when the conventional golf club head 10 travels along a parabolic path. The conventional golf club head 10 is thus prevented from deviating from the intended path at such time when the conventional golf club head 10 is moved to hit the golf ball.

SUMMARY OF THE INVENTION

The present invention provides a golf club head having air flow guiding slot with uneven surface. The golf club head of the invention includes a ball striking plate, a connection portion, a top plate, a bottom portion and at least one air flow guiding slot. The connection portion is connected to the ball striking plate. The top plate is connected to the ball striking plate and the connection portion. The bottom portion is connected to the ball striking plate, the connection portion and the top plate. The at least one air flow guiding slot is mounted on the top plate and the bottom portion, is near to the connection portion, and has an uneven surface.

Utilizing the uneven surface of the at least one air flow guiding slot, the stability of air flow can be improved. Furthermore, the uneven surface is used to greatly increase the surface area of the air flow guiding slot so as to raise the weight so that the centre of gravity for the golf club head can be mounted on the at least one air flow guiding slot.

DETAILED DESCRIPTION OF THE INVENTION

Figure 1:
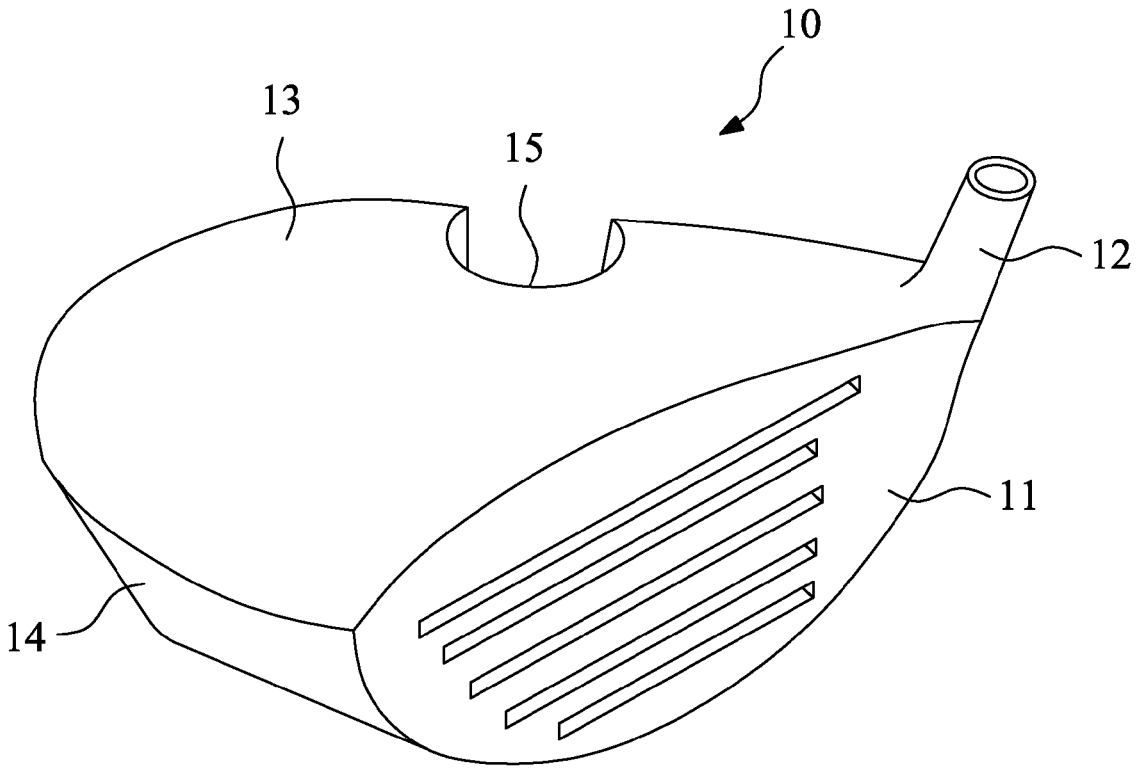
FIG. 1 shows the conventional golf club head.
Figure 2:
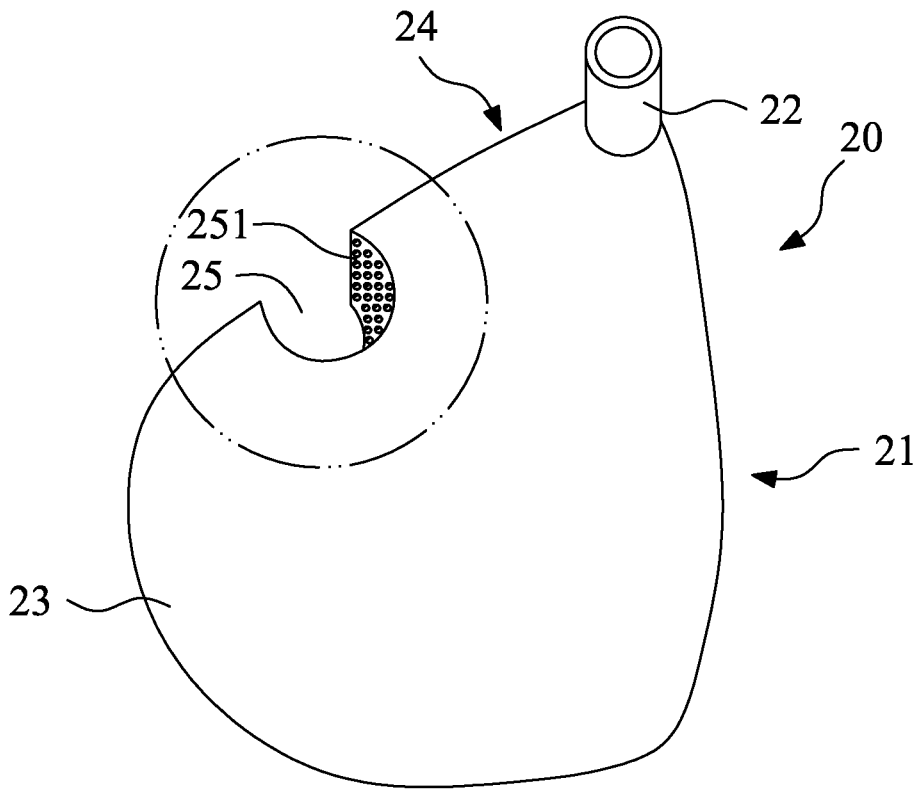
FIG. 2 shows a top view of golf club head having air flow guiding slot with uneven surface according to a first embodiment of the present invention.
Figure 3:
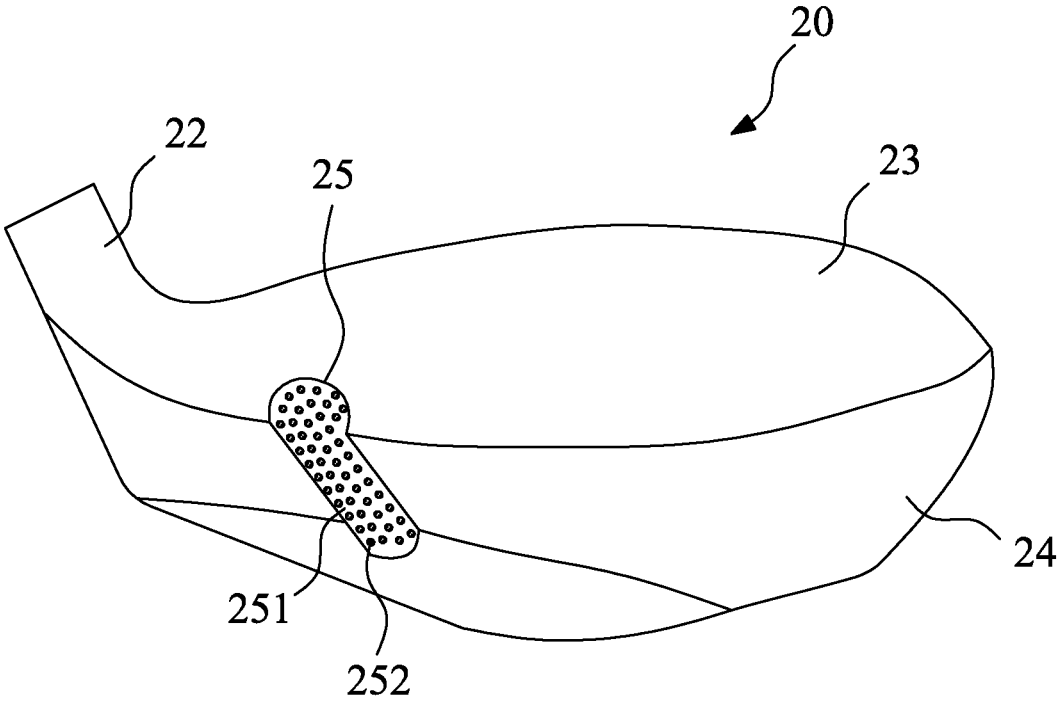
FIG. 3 shows a side view of golf club head having air flow guiding slot with uneven surface according to the first embodiment of the present invention.

Referring to FIG. 2, it shows a top view of golf club head having air flow guiding slot with uneven surface according to a first embodiment of the present invention. Referring to FIG. 3, it shows a side view of golf club head having air flow guiding slot with uneven surface according to the first embodiment of the present invention. The golf club head 20 having air flow guiding slot with uneven surface of the invention includes a ball striking plate 21, a connection portion 22, a top plate 23, a bottom portion 24 and at least one air flow guiding slot 25. The connection portion 22 is connected to the ball striking plate 21. The top plate 23 is connected to the ball striking plate 21 and the connection portion 22. The bottom portion 24 is connected to the ball striking plate 21, the connection portion 22 and the top plate 23.

The at least one air flow guiding slot 25 is mounted on the top plate 23 and the bottom portion 24, that is, a circular arc slot is formed on the top plate 23 and extends to the bottom portion 24. The at least one air flow guiding slot 25 is near to the connection portion 22, and has an uneven surface 251.

Figure 2A:
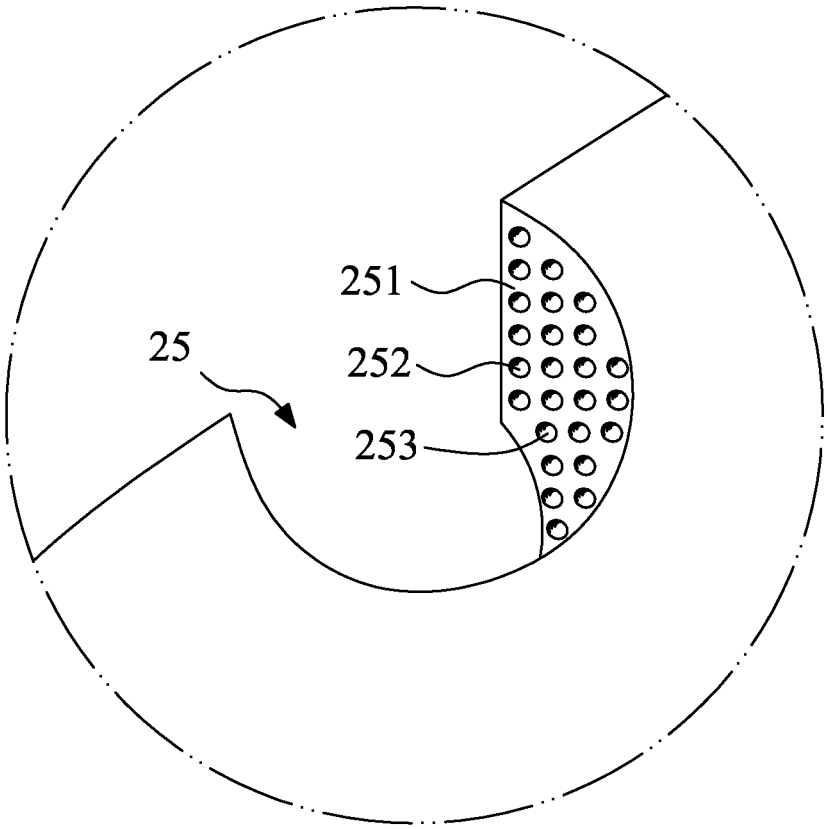
FIG. 2*a* shows a partial enlarged view of air flow guiding slot of golf club head according to the first embodiment of the present invention.

Referring to FIG. 2*a*, it shows a partial enlarged view of air flow guiding slot of golf club head according to the first embodiment of the present invention. In this embodiment, the uneven surface 251 of the air flow guiding slot 25 includes a plurality of recesses 252, 253. The recesses 252, 253 are round. In the other embodiment, the recesses can be triangular, rectangular or any kind of shape. The higher density of the recesses 252, 253 on the uneven surface 251 is better. Namely, as shown in FIG. 2*a*, the plurality of recesses 252, 253 forms a high-density pattern.

Figure 2B:
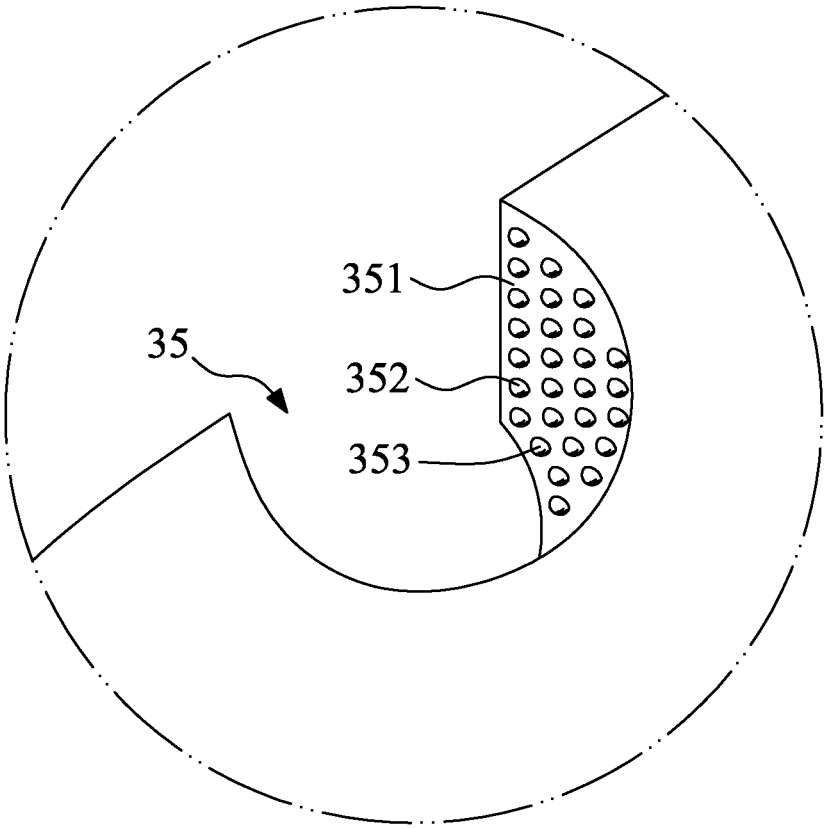
FIG. 2*b* shows a partial enlarged view of air flow guiding slot of golf club head according to another example of the first embodiment of the present invention.

Referring to FIG. 2*b*, it shows a partial enlarged view of air flow guiding slot of golf club head according to another example of the first embodiment of the present invention. In this example, the uneven surface 351 of the air flow guiding slot 35 includes a plurality of protrusions 352, 353. The protrusions 352, 353 are round. In the other embodiment, the protrusions can be triangular, rectangular or any kind of shape. As shown in FIG. 2*b*, the plurality of protrusions 352, 353 also forms a high-density pattern.

Utilizing the uneven surface of the at least one air flow guiding slot, the stability of air flow can be improved. Compared with the conventional golf club head, the golf club head of the invention can increase the stability of air flow about 30%. Furthermore, the uneven surface is used to greatly increase the surface area of the air flow guiding slot so as to raise the weight of the air flow guiding slot so that the centre of gravity for the golf club head can be mounted on the at least one air flow guiding slot.

Figure 4:
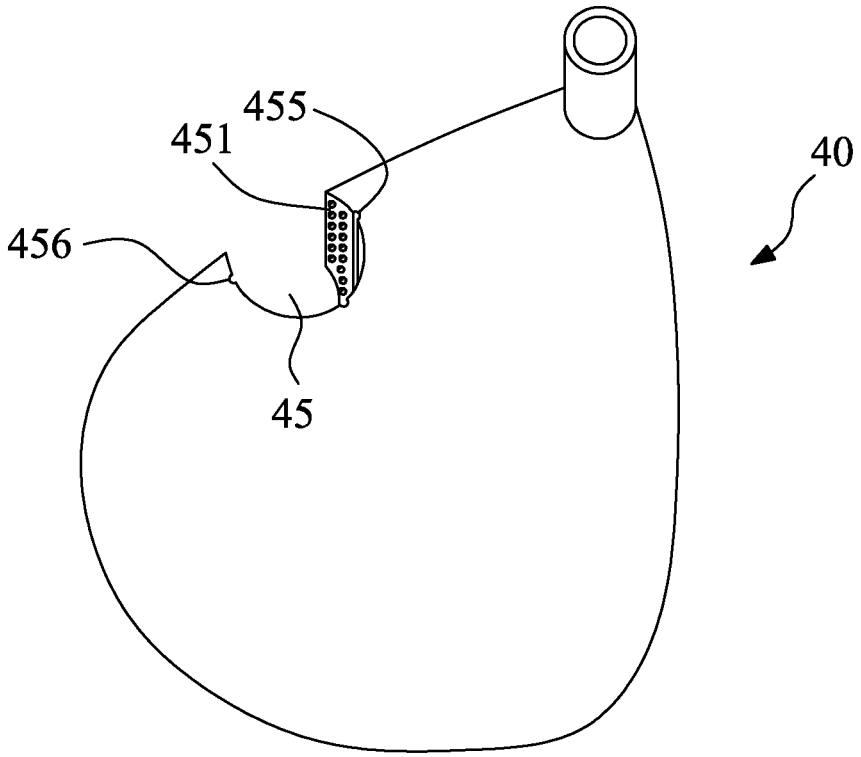
FIG. 4 shows a top view of golf club head having air flow guiding slot with uneven surface according to a second embodiment of the present invention.

Referring to FIG. 4, it shows a top view of golf club head having air flow guiding slot with uneven surface according to a second embodiment of the present invention. Compared with the golf club head of the first embodiment, the golf club head 40 of the second embodiment further includes at least one auxiliary slot 455, 456 mounted on the uneven surface 451 of the at least one air flow guiding slot 45. In this embodiment, the at least one auxiliary slot 455, 456 are formed as circular arcs. In the other embodiment, the at least one auxiliary slot can be any kind of shape.

Figure 5:
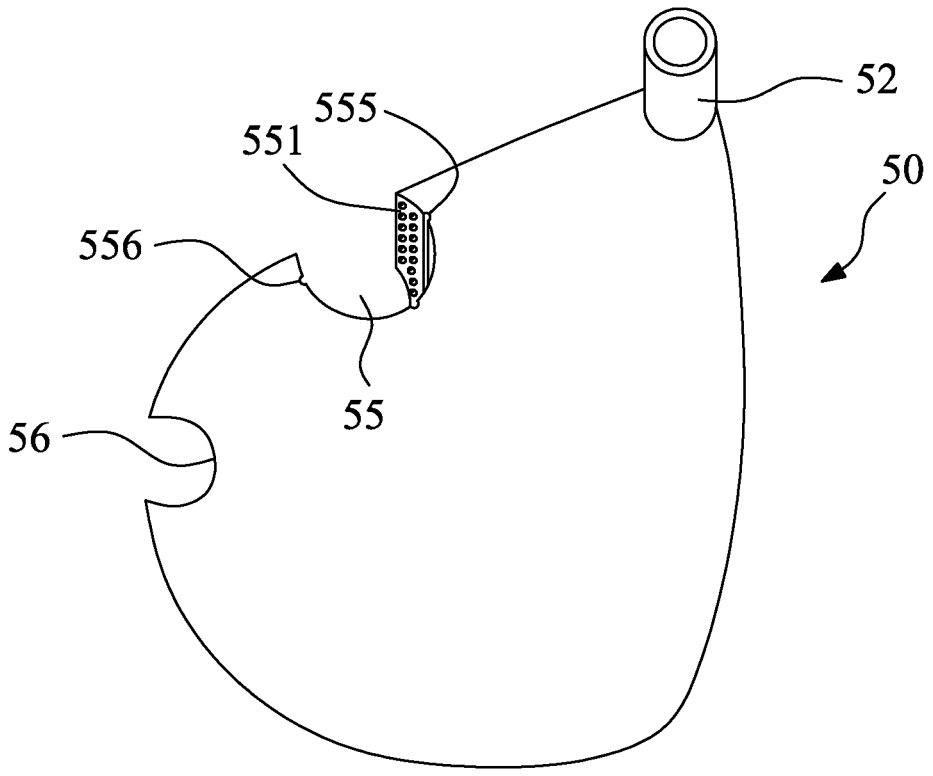
FIG. 5 shows a top view of golf club head having air flow guiding slot with uneven surface according to a third embodiment of the present invention.

Referring to FIG. 5, it shows a top view of golf club head having air flow guiding slot with uneven surface according to a third embodiment of the present invention. The golf club head 50 of the third embodiment includes a first air flow guiding slot 55 and a second air flow guiding slot 56. The first air flow guiding slot 55 is near to the connection portion 52. The first air flow guiding slot 55 further includes at least one auxiliary slot 555, 556 mounted on the uneven surface 551 of the first air flow guiding slot 55. In this embodiment, the first air flow guiding slot 55 and the second air flow guiding slot 56 are formed as circular arcs. The first air flow guiding slot 55 is bigger than the second air flow guiding slot 56.

Utilizing the auxiliary slot or the second air flow guiding slot, the stability of air flow can be further improved. The area of the air flow guiding slot can be further increased so as to raise the weight of the air flow guiding slot so that the centre of gravity for the golf club head can be mounted on the air flow guiding slot.

While several embodiments of the present invention have been illustrated and described, various modifications and improvements can be made by those skilled in the art. The embodiments of the present invention are therefore described in an illustrative but not in a restrictive sense. It is intended that the present invention should not be limited to the particular forms as illustrated and that all modifications which maintain the spirit and scope of the present invention are within the scope defined in the appended claims.

What is claimed is:

1. A golf club head having air flow guiding slot with uneven surface, comprising:

a ball striking plate;

a connection portion, connected to the ball striking plate;

a top plate, connected to the ball striking plate and the connection portion;

a bottom portion, connected to the ball striking plate, the connection portion and the top plate;

at least one air flow guiding slot, mounted on the top plate and the bottom portion, being near to the connection portion, and having an uneven surface comprising a plurality of recesses or a plurality of protrusions; and a centre of gravity of the golf club head disposed on the at least one air flow guiding slot;

wherein the plurality of recesses or protrusions forms a high-density pattern.

2. The golf club head according to claim 1, wherein the recesses are round, triangular or rectangular.

3. The golf club head according to claim 1, wherein the protrusions are round, triangular or rectangular.

4. The golf club head according to claim 1, further comprising at least one auxiliary slot mounted on the uneven surface of the at least one air flow guiding slot.

5. The golf club head according to claim 1, wherein the at least one air flow guiding slot comprises a first air flow guiding slot and a second air flow guiding slot, the first air flow guiding slot is near to the connection portion.

6. The golf club head according to claim 5, wherein the first air flow guiding slot is bigger than the second air flow guiding slot.

7. The golf club head according to claim 1, wherein the at least one air flow guiding slot is formed as a circular arc.

* * * * *